US008077113B2

(12) United States Patent
Syed et al.

(10) Patent No.: US 8,077,113 B2
(45) Date of Patent: Dec. 13, 2011

(54) RADOME AND SHROUD ENCLOSURE FOR REFLECTOR ANTENNA

(75) Inventors: Junaid Syed, Fife (GB); Matthew Lewry, Fife (GB); Ian Renilson, Fife (GB); Stephen Simms, Dunfermline (GB)

(73) Assignee: Andrew LLC, Hickory, NY (US)

( * ) Notice: Subject to any disclaimer, the term of this patent is extended or adjusted under 35 U.S.C. 154(b) by 441 days.

(21) Appl. No.: 12/484,123

(22) Filed: Jun. 12, 2009

(65) Prior Publication Data

US 2010/0315307 A1 Dec. 16, 2010

(51) Int. Cl.
*H01Q 1/42* (2006.01)

(52) U.S. Cl. ..... 343/872; 343/912

(58) Field of Classification Search ..... 343/872, 343/912

See application file for complete search history.

(56) References Cited

U.S. PATENT DOCUMENTS

| | | | | |
|---|---|---|---|---|
| 2,413,187 | A | 12/1946 | McCurdy et al. | |
| 3,140,491 | A | 7/1964 | Ashbaugh et al. | |
| 3,351,947 | A * | 11/1967 | Hart | 343/840 |
| 3,599,219 | A | 8/1971 | Holtum et al. | |
| 3,740,755 | A * | 6/1973 | Grenzeback | 343/840 |
| 4,410,892 | A | 10/1983 | Knop et al. | |
| 4,581,615 | A | 4/1986 | Levy | |
| 4,876,554 | A | 10/1989 | Tubbs | |
| 5,298,911 | A | 3/1994 | Li | |
| 5,341,150 | A | 8/1994 | Joy | |
| 6,094,174 | A | 7/2000 | Knop et al. | |
| 6,137,449 | A | 10/2000 | Kildal | |
| 6,339,393 | B1 | 1/2002 | Burnside et al. | |
| 6,522,305 | B2 | 2/2003 | Sharman | |
| 7,075,492 | B1 * | 7/2006 | Chen et al. | 343/755 |
| 7,138,958 | B2 | 11/2006 | Syed et al. | |
| 2005/0035923 | A1 * | 2/2005 | Syed et al. | 343/872 |

* cited by examiner

*Primary Examiner* — Hoanganh Le
(74) *Attorney, Agent, or Firm* — Babcock IP, PLLC

(57) ABSTRACT

An enclosure for the open end of a reflector antenna includes a cylindrical shroud coupled to a distal end of the reflector antenna, the shroud generally coaxial with a longitudinal axis of the reflector antenna. A retaining band is coupled to an inner diameter of the shroud, proximate a distal end of the shroud. The retaining band is provided with a retaining groove open radially inward towards the longitudinal axis. The retaining groove provided with a bottom extending radially outward beyond an outer diameter of the shroud. A radome is seated within the retaining groove.

15 Claims, 11 Drawing Sheets

RADOME AND SHROUD ENCLOSURE FOR REFLECTOR ANTENNA

BACKGROUND

1. Field of the Invention

This invention relates to microwave reflector antennas. More particularly, the invention relates to a radome and shroud enclosure for reflector antennas with improved signal pattern and mechanical characteristics.

2. Description of Related Art

The open end of a reflector antenna is typically enclosed by a radome coupled to the distal end of the reflector dish and/or of a cylindrical shroud extending from the reflector dish.

The radome provides environmental protection and improves wind load characteristics of the antenna. Precision shaping may be applied to the radome to compensate for signal trajectory and/or reflection effects resulting from an impedance discontinuity introduced into the signal path of the reflector antenna by the presence of the radome. Edge(s) of the radome attachment arrangement scatter the RF signal degrading the signal pattern. Significantly, edges parallel to the signal path, such as the distal edge of a cylindrical shroud, are known to diffract signal energy present in this area, introducing undesirable backlobes into the reflector antenna signal pattern.

Prior antenna signal pattern backlobe suppression techniques include adding a backlobe suppression ring to the radome, for example via metalizing of the radome periphery as disclosed in commonly owned U.S. Pat. No. 7,138,958, titled "Reflector Antenna Radome with Backlobe Suppressor Ring and Method of Manufacturing" issued Nov. 21, 2006 to Syed et al, hereby incorporated by reference in its entirety. However, the required metalizing operations may increase manufacturing complexity and/or cost, including elaborate coupling arrangements configured to securely retain the shroud upon the reflector dish without presenting undesired reflection edges and/or extending the overall size of the radome. Further, the thin metalized ring layer applied to the periphery of the radome may be fragile, requiring increased care to avoid damage during delivery and/or installation.

The addition of a shroud to a reflector antenna improves the signal pattern generally as a function of the shroud length, but also similarly introduces significant costs as the increasing length of the shroud also increases wind loading of the reflector antenna, requiring a corresponding increase in the antenna and antenna support structure strength.

Competition in the reflector antenna market has focused attention on improving electrical performance and minimization of overall manufacturing, inventory, distribution, installation and maintenance costs. Therefore, it is an object of the invention to provide a radome and shroud enclosure for a reflector antenna that overcomes deficiencies in the prior art.

BRIEF DESCRIPTION OF THE DRAWINGS

The accompanying drawings, which are incorporated in and constitute a part of this specification, illustrate embodiments of the invention, where like reference numbers in the drawing figures refer to the same feature or element and may not be described in detail for every drawing figure in which they appear and, together with a general description of the invention given above, and the detailed description of the embodiments given below, serve to explain the principles of the invention.

DETAILED DESCRIPTION

Figure 1:
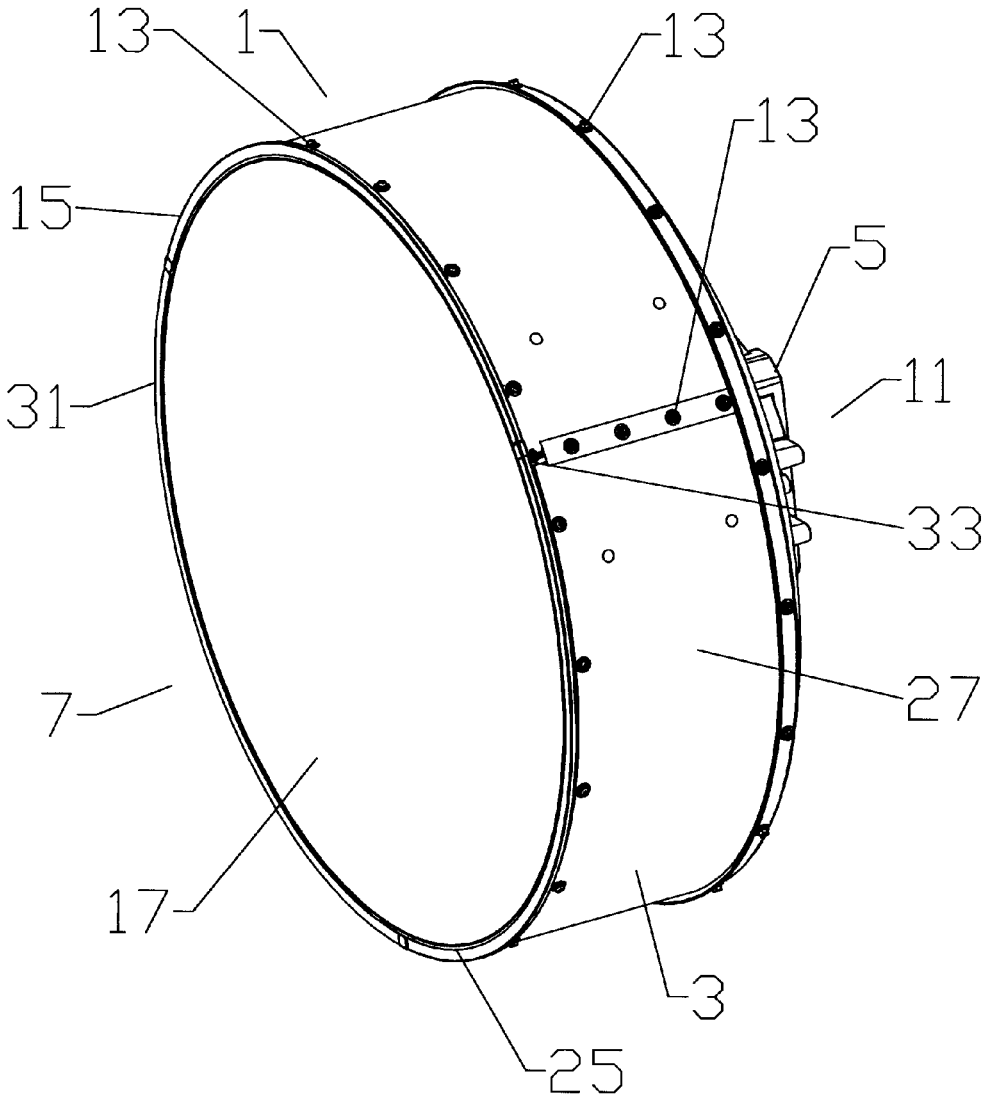
FIG. 1 is a schematic isometric front view of a reflector antenna with an exemplary shroud and radome enclosure.
Figure 2:
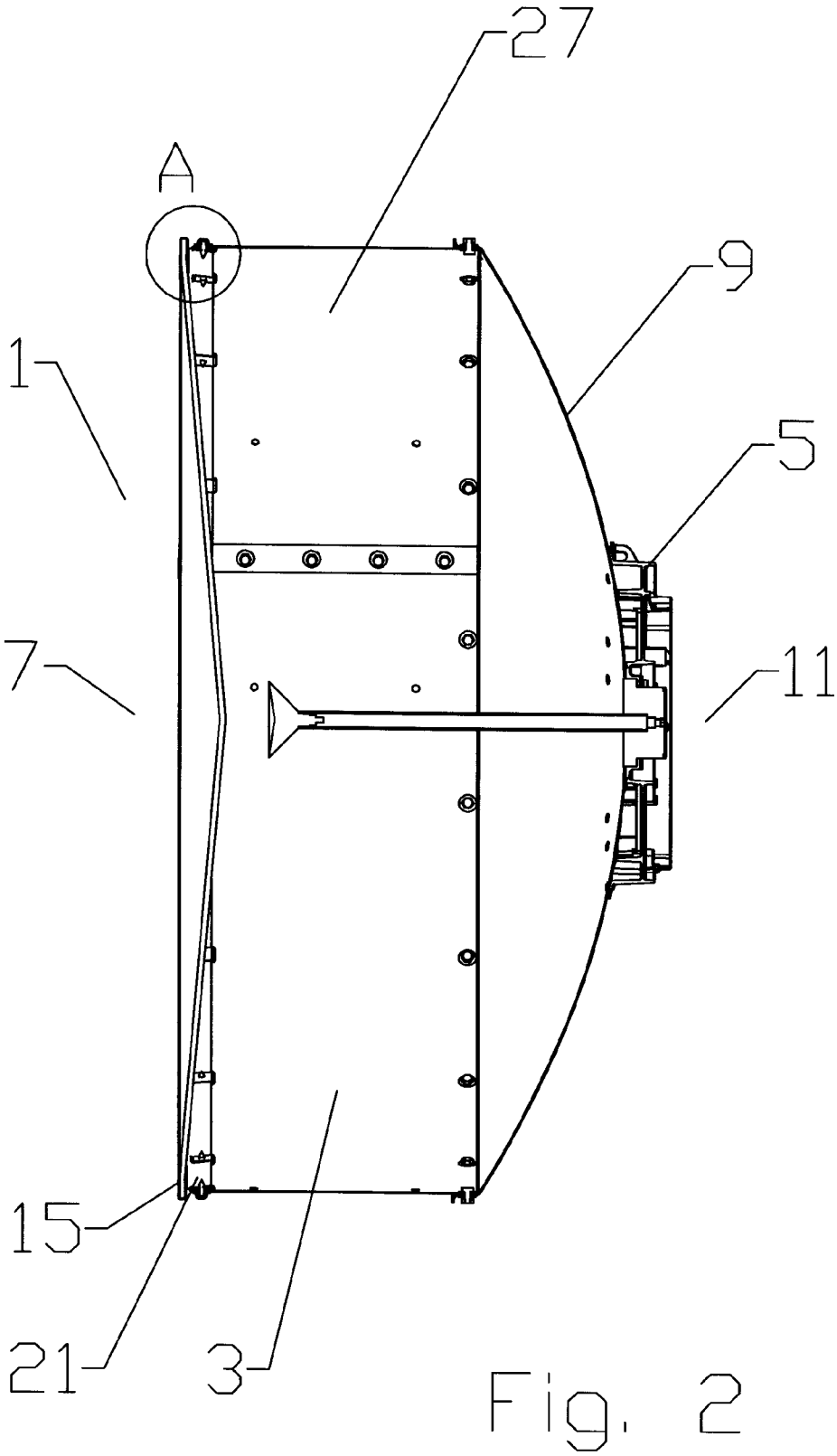
FIG. 2 is a schematic cut-away side view of the reflector antenna of FIG. 1, wherein RF absorbing material is omitted for clarity.

A first exemplary embodiment of a reflector antenna enclosure 1 is demonstrated in FIGS. 1-11. A cylindrical shroud 3 extends, generally coaxial with a longitudinal axis of the reflector antenna 5, from a distal end 7 of the reflector dish 9. A proximal end 11 of the shroud 3 is coupled, for example via mechanical fastener(s) 13 or the like, to the periphery of the reflector dish 9. A retaining band 15 may be coupled to an inner diameter of the shroud 3, proximate the distal end 7 of the shroud 3. A radome 17 enclosing the distal end 7 of the shroud 3 cavity is seated within a retaining groove 19 of the retaining band 15.

Figure 3:
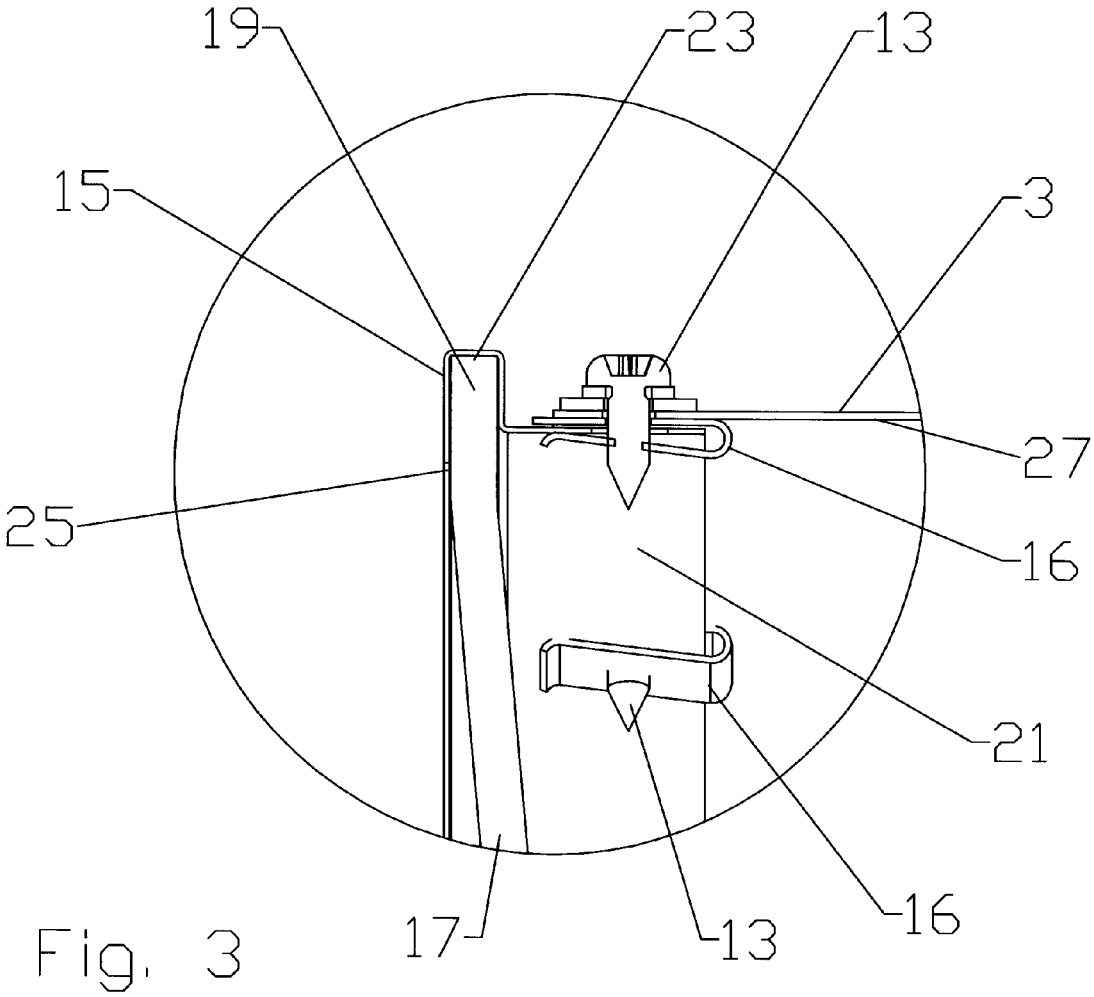
FIG. 3 is a close-up view of area A of FIG. 2.
Figure 4:
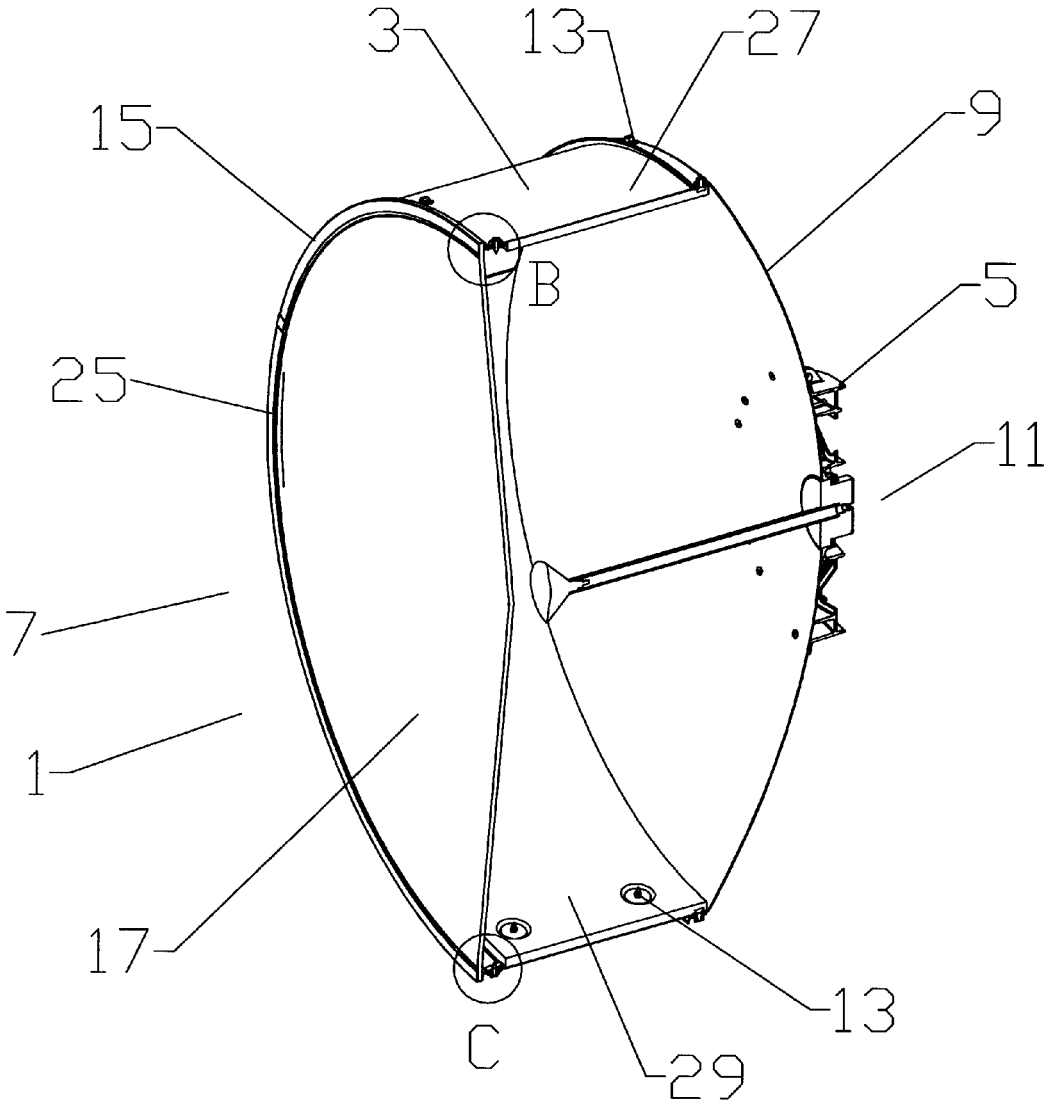
FIG. 4 an isometric cut-away side view of the reflector antenna of FIG. 1.
Figure 5:
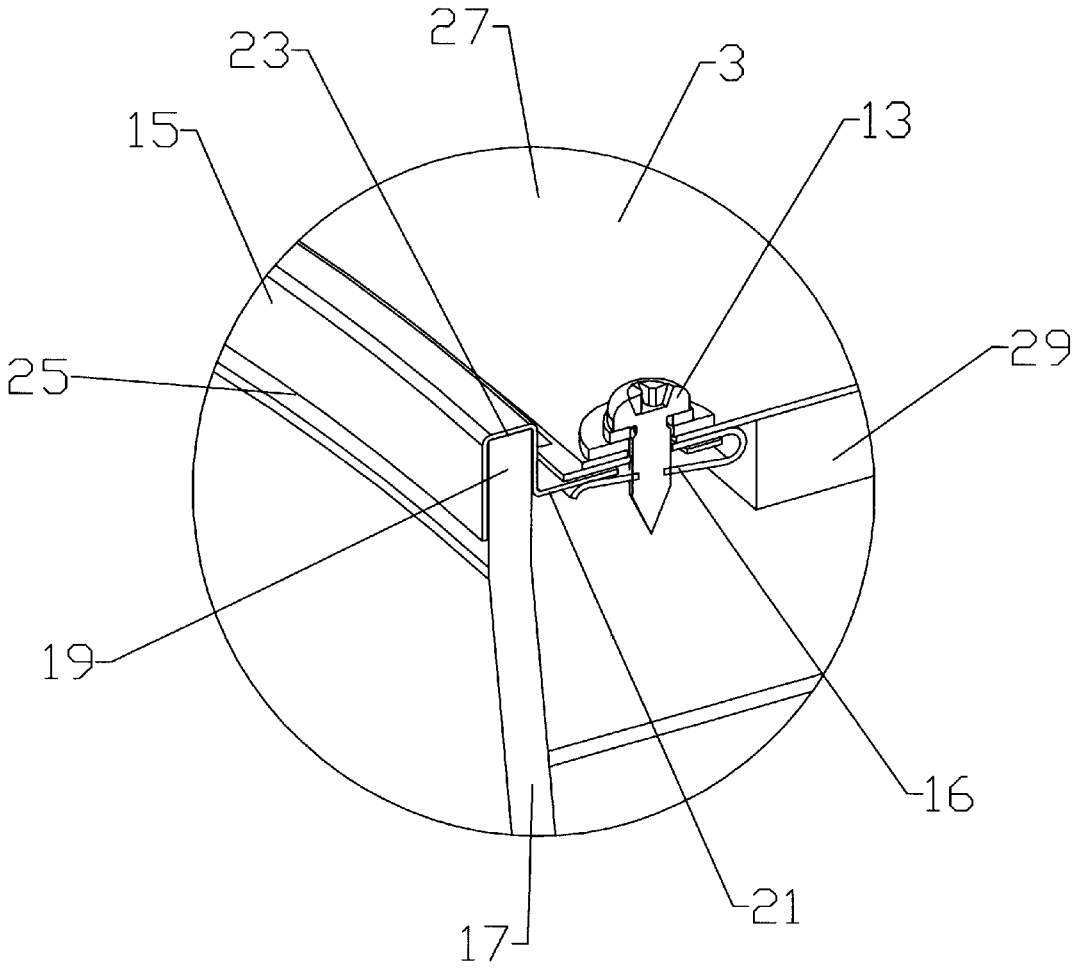
FIG. 5 is a close-up view of area B of FIG. 4.
Figure 6:
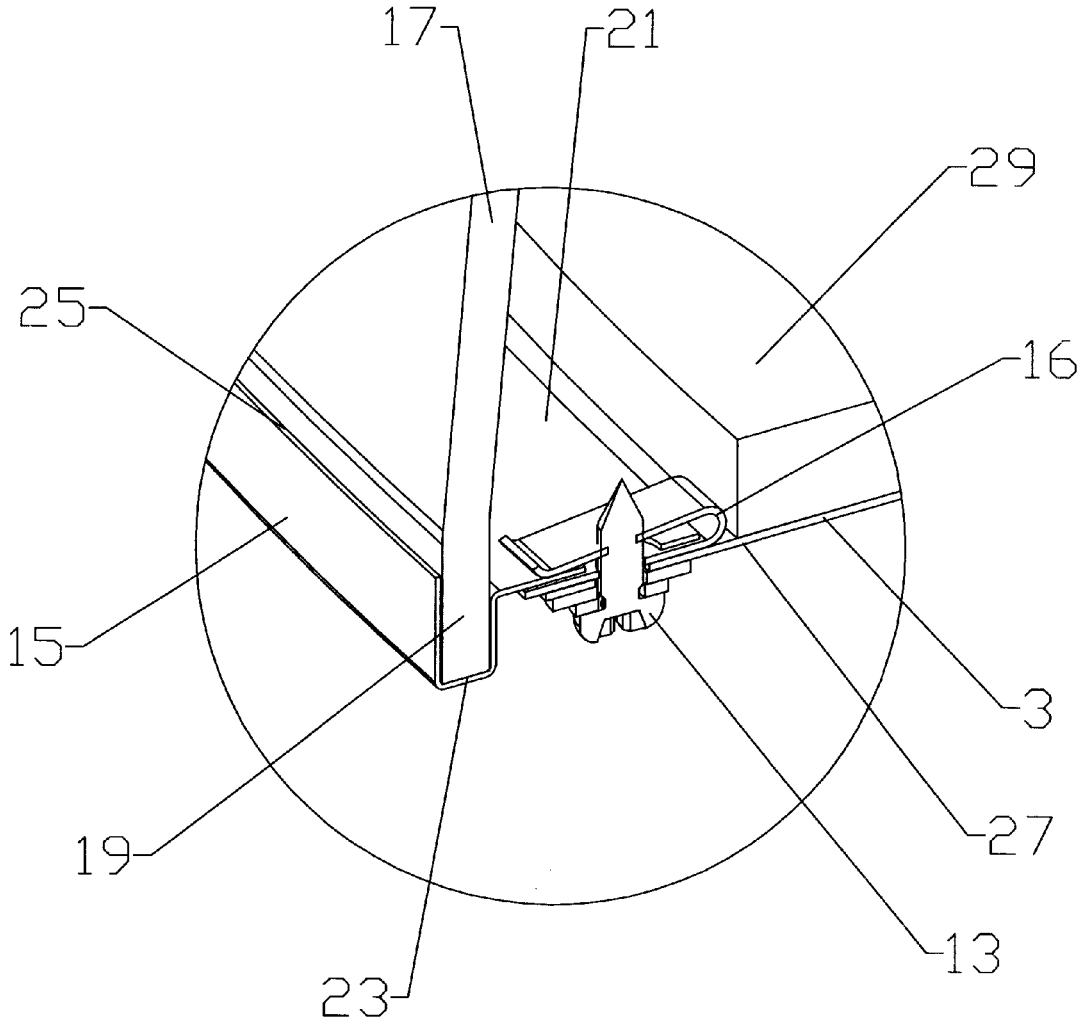
FIG. 6 is a close-up view of area C of FIG. 4.

The retaining band 15 has a cross section best demonstrated in FIG. 3. A mounting portion 21 of the retaining band 15 is coaxial with the shroud 3, dimensioned to seat against the inner diameter of the distal end 7 of the shroud 3, fastened for example by a plurality of fastener(s) 13 each threaded into a respective clip 16 placed upon the mounting portion 21. The retaining groove 19 extends outward from the mounting portion 21, open towards the longitudinal axis of the reflector antenna 5. A bottom 23 of the retaining groove 19 has an inner diameter that is greater than an outer diameter of the shroud 3. A width of the retaining groove 19 may generally correspond to a width of the radome periphery, enabling the radome periphery to seat within the retaining groove 19 and be retained thereby.

To provide an improved choke effect upon signal energy in the area of the retaining groove 19, the retaining groove 19 may be provided with a depth with respect to the mounting portion 21 that is greater than the width of the retaining groove 19. That is, the retaining groove bottom 23 may be provided with an inner diameter that is greater than the inner diameter of the mounting portion 21 by greater than the width of the retaining groove 19. Further, a radial inward edge 25 of the retaining band 15 may be provided with an inner diameter that is less than an inner diameter of the mounting portion 21. Thereby, the longitudinal length of the shroud 3 may reduced without unacceptably degrading the front-to-back ratio/back lobe signal pattern of the resulting reflector antenna 5.

As shown in FIGS. 4-6, 10 and 11, an RF absorbing material 29 may be applied to the inner diameter of the shroud 3, further reducing RF signal reflections therealong. If the shroud 3 is formed from polymer material, at least portions of the shroud 3 that are not covered by RF absorbing material 29 may be metalized to provide an RF signal block.

The retaining band 15 may also provide a reinforcing function for the shroud 3, enabling the shroud 3 to be cost effectively formed, for example, from multiple portion(s) 27 of sheet metal and/or polymer material. To simplify manufacturing, reduce inventory and delivery costs, the portions may be assembled at the point of installation by coupling them end to end via fasteners or the like to form the shroud cylinder. Similarly, the RF absorbing material 29 may be mechanically fastened to the shroud inner diameter, enabling compact storage and delivery configurations with limited risk of damaging the relatively fragile RF absorbing material.

Figure 7:
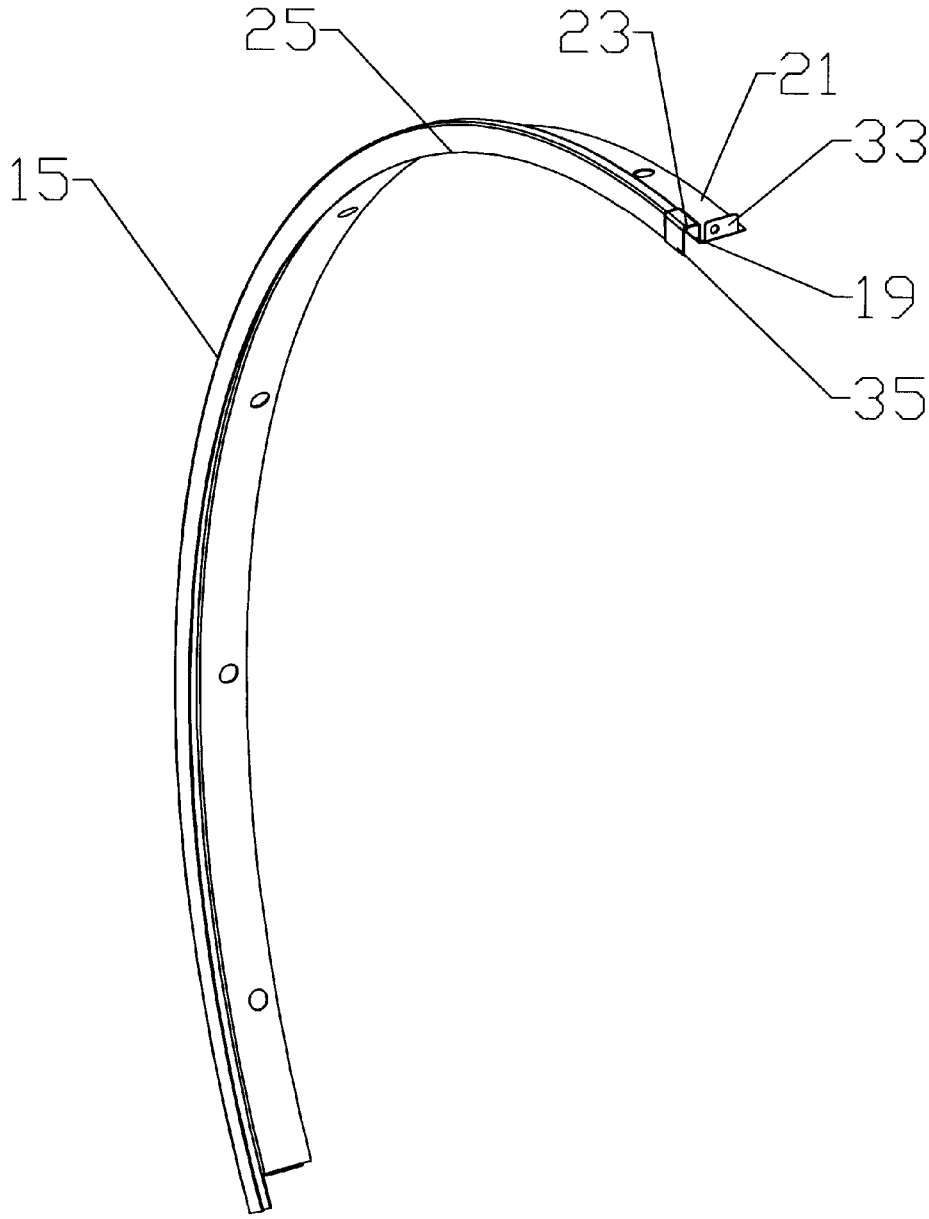
FIG. 7 is a schematic isometric front view of a retaining band arc segment of FIG. 1.
Figure 8:
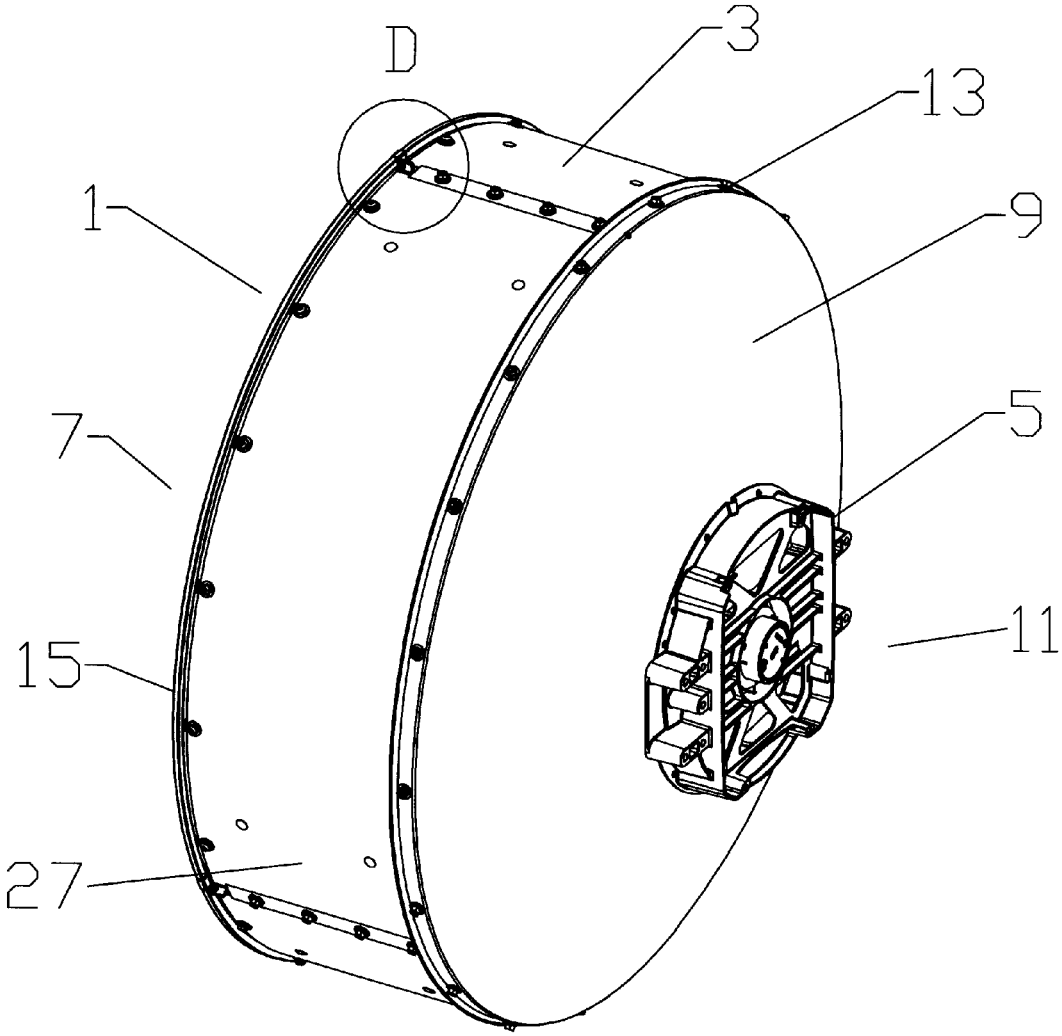
FIG. 8 is a schematic isometric back view of the reflector antenna of FIG. 1.
Figure 9:
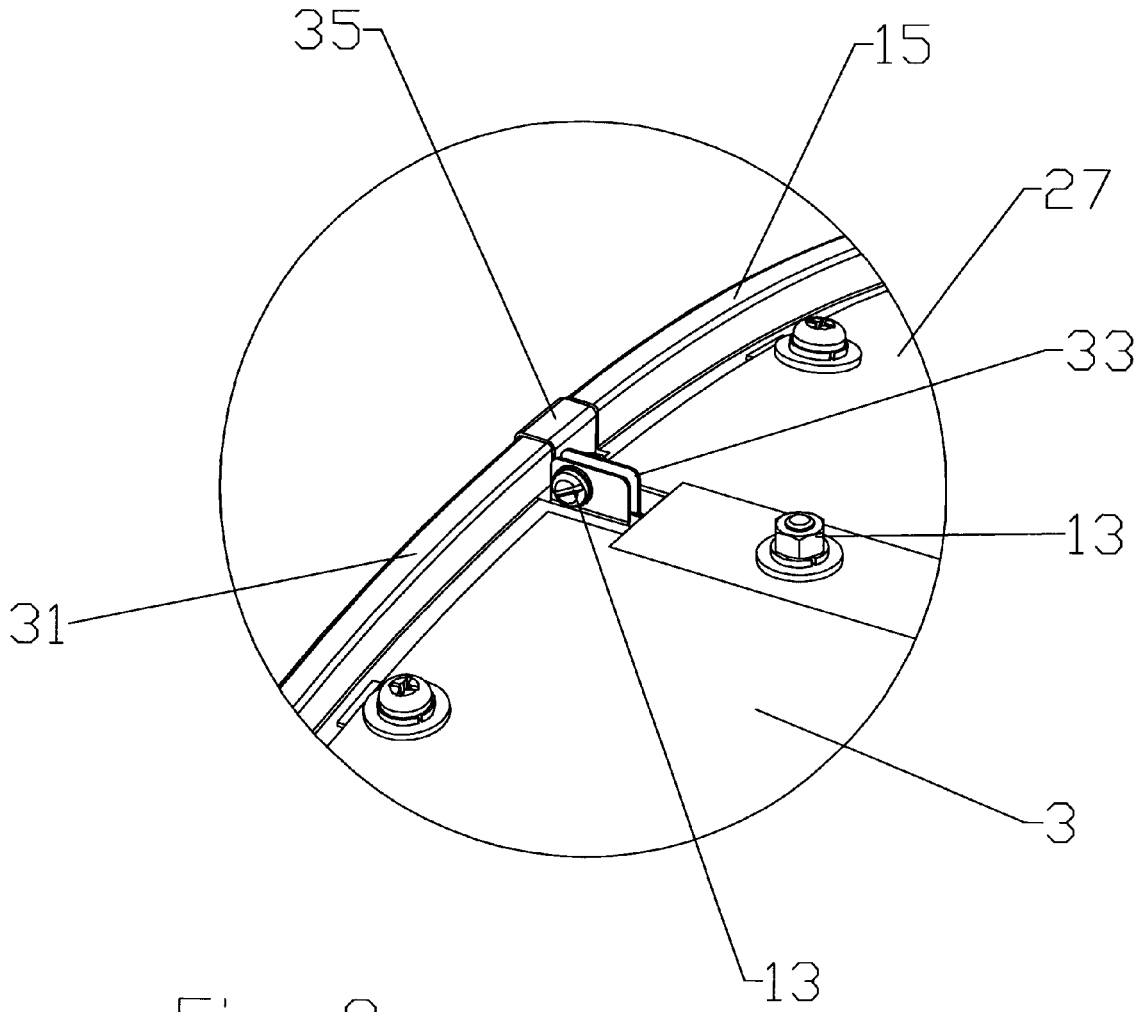
FIG. 9 is a close-up view of area D of FIG. 8.
Figure 10:
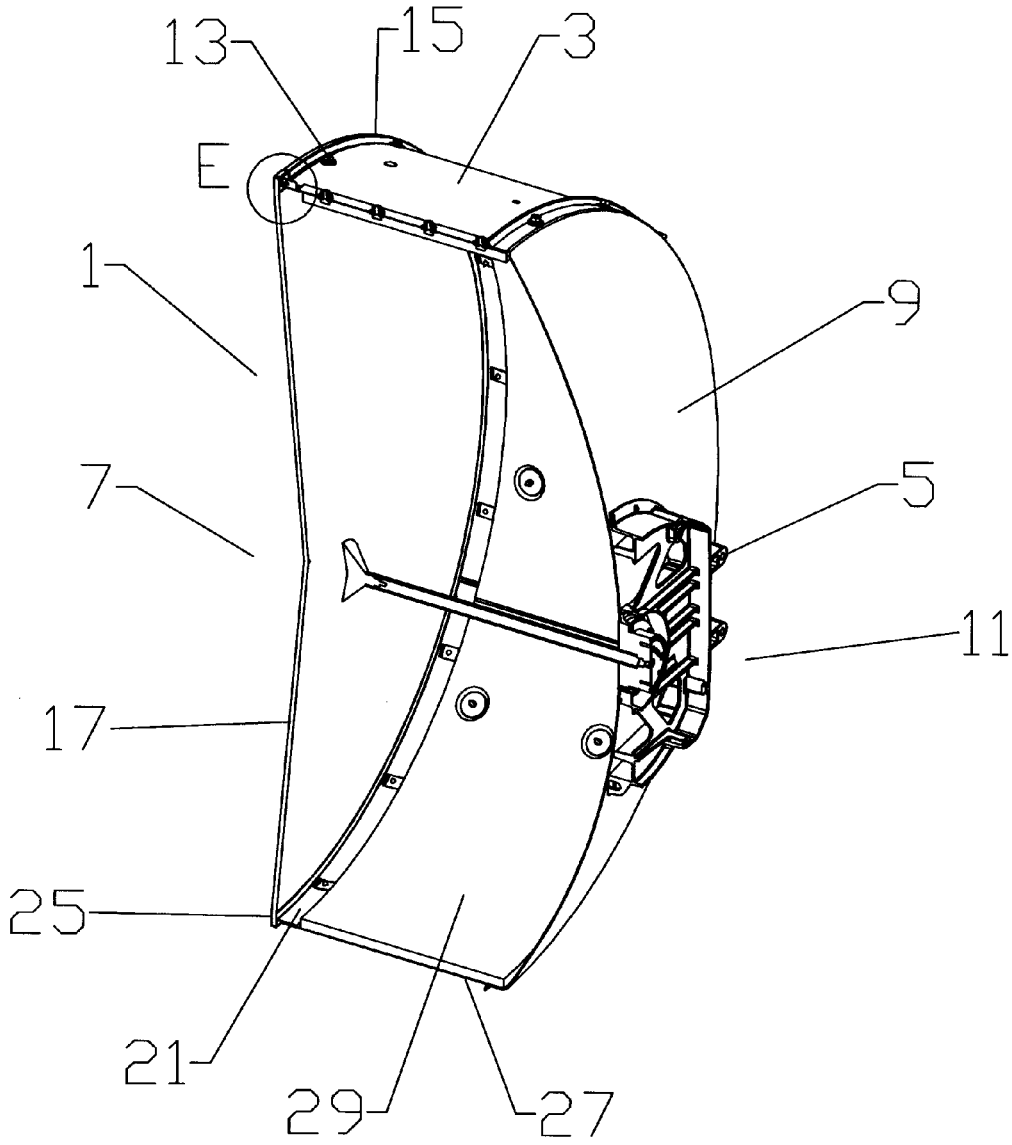
FIG. 10 is an isometric cut-away side view of the reflector antenna of FIG. 1.
Figure 11:
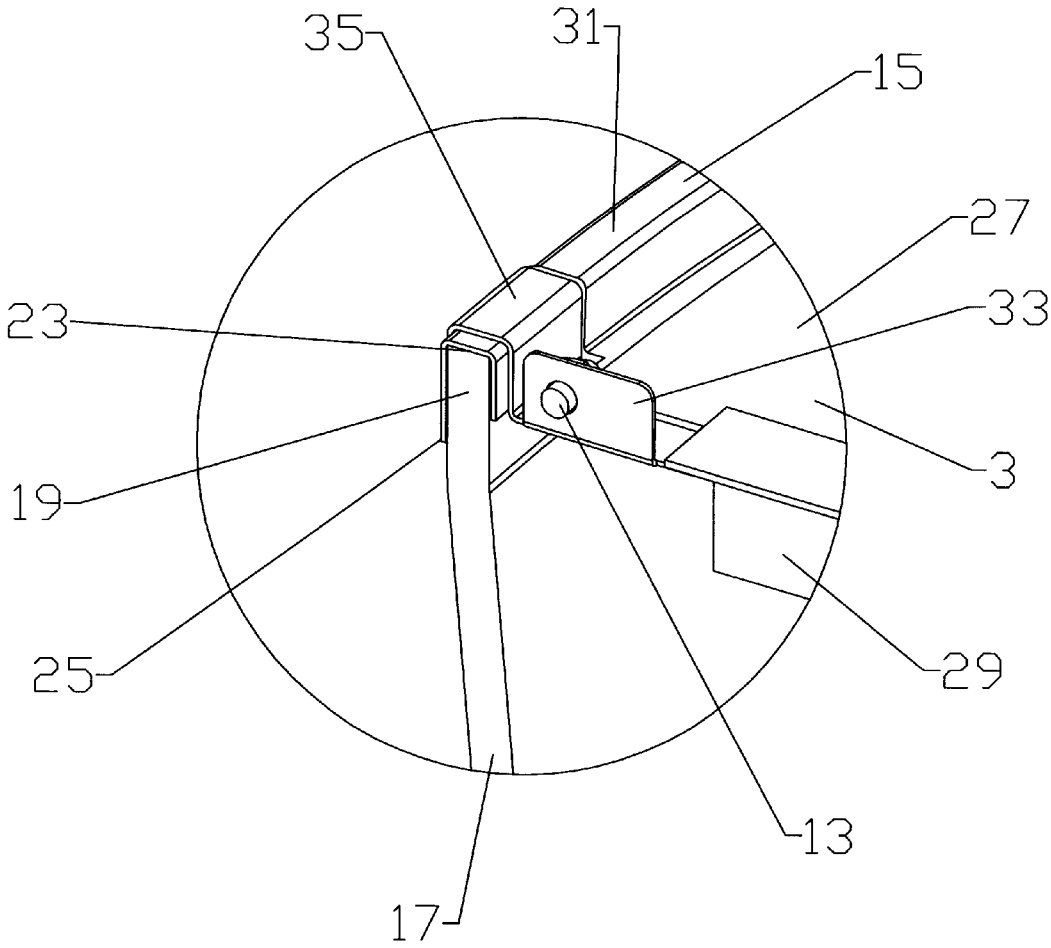
FIG. 11 is a close-up view of area E of FIG. 10.

The retaining band 15 may be formed as a C-ring or alternatively as best shown for example in FIG. 7 as a plurality of retaining band 15 arc segment(s) 31 that are fastened together to form the annular shape of the retaining band 15. Where the retaining band 15 is formed from arc segment(s) 31, the arc segment(s) 31 may be formed with an end flare 35 wherein an end portion of each arc segment 31 can seat within and overlap one another. In addition and/or alternatively, the end portion(s) of each arc segment 31 may be provided with a coupling tab 33 through which a fastener 13 may be applied to couple the arc segment(s) 31 to one another, as best shown in FIGS. 8-11.

Because the retaining groove 19 is isolated from the shroud 3, the radome 17 makes no contact with the shroud 3. Therefore, the characteristics of the fit between the retaining groove 15 and the radome 17 has no effect upon the interconnection between the shroud 3 and the retaining band 15. The dimensions determining the fit between the radome periphery and the retaining groove 19 may be selected to be an interference fit, immobilizing the radome 17 with respect to the retaining band 15 and improving the integrity of the shroud 3 and radome 17, for example with respect to resisting deformation under high sustained and/or gusting wind loads. Alternatively, dimensions resulting in a looser fit may be selected allowing the radome 17 to float and/or rotate within the retaining groove 19. A looser fit enables, for example, compensation for different thermal expansion characteristics of the selected radome 17 and retaining band 15 materials.

Because the retaining groove 19 provides a circumferential retention of the radome 17 dependent upon the strength of the, for example metal, retaining band 15, the radome 17 retention is very secure, even if a relatively low strength material and/or thickness is selected for the radome 17. Further, the prior attachment features formed in the radome periphery have been eliminated, greatly simplifying radome 17 and also shroud distal end manufacture.

One skilled in the art will appreciate that in addition to improving the electrical performance of the reflector antenna 5, the reflector antenna enclosure 1 enables significant manufacturing, delivery, installation and/or maintenance efficiencies.

| Table of Parts | |
|---|---|
| 1 | reflector antenna enclosure |
| 3 | shroud |
| 5 | reflector antenna |
| 7 | distal end |
| 9 | reflector dish |
| 11 | proximal end |
| 13 | fastener |
| 15 | retaining band |
| 16 | clip |
| 17 | radome |
| 19 | retaining groove |
| 21 | mounting portion |
| 23 | bottom |
| 25 | edge |
| 27 | portion |
| 29 | RF absorbing material |
| 31 | arc segment |

-continued

| Table of Parts | |
|---|---|
| 33 | coupling tab |
| 35 | end flare |

Where in the foregoing description reference has been made to materials, ratios, integers or components having known equivalents then such equivalents are herein incorporated as if individually set forth.

While the present invention has been illustrated by the description of the embodiments thereof, and while the embodiments have been described in considerable detail, it is not the intention of the applicant to restrict or in any way limit the scope of the appended claims to such detail. Additional advantages and modifications will readily appear to those skilled in the art. Therefore, the invention in its broader aspects is not limited to the specific details, representative apparatus, methods, and illustrative examples shown and described. Accordingly, departures may be made from such details without departure from the spirit or scope of applicant's general inventive concept. Further, it is to be appreciated that improvements and/or modifications may be made thereto without departing from the scope or spirit of the present invention as defined by the following claims.

We claim:

1. An enclosure for an open end of a reflector antenna, comprising:

a substantially cylindrical shroud adapted to be coupled to a distal end of the reflector antenna, the shroud generally coaxial with a longitudinal axis of the reflector antenna;

a retaining band coupled to an inner diameter of the shroud, proximate a distal end of the shroud;

the retaining band provided with a retaining groove open radially inward towards the longitudinal axis;

a bottom of the retaining groove extending radially outward beyond an outer diameter of the shroud; and a radome seated within the retaining groove.

2. The enclosure of claim 1, wherein the retaining band is formed by a plurality of arc segments.

3. The enclosure of claim 2, further including an end flare on each of the arc segments, whereby an end of each arc segment overlaps an adjacent arc segment.

4. The enclosure of claim 2, further including a coupling tab proximate an end of each arc segment, the coupling tabs fastened one to another.

5. The enclosure of claim 1, further including an RF absorbing material coupled to the inner diameter of the shroud.

6. The enclosure of claim 5, wherein the RF absorbing material is mechanically fastened to the shroud.

7. The enclosure of claim 1, wherein a diameter at the bottom of the retaining groove is greater than an outer diameter of the shroud by at least one width of the retaining groove.

8. The enclosure of claim 1, wherein the retaining band is coupled to the shroud by fasteners coupled through an outer diameter of the shroud to clips seated on a proximal edge of the retaining band.

9. The enclosure of claim 1, wherein the radome does not contact the shroud.

10. The enclosure of claim 1, wherein the radome is rotatable within the retaining groove.

11. The enclosure of claim 1, wherein the radome is movable within the retaining groove.

12. The enclosure of claim 1, wherein a radial inward edge of the retaining band has a smaller inner diameter than the shroud.

13. The enclosure of claim 1, wherein a radial inward edge of the retaining band has a smaller inner diameter than a proximal end of the retaining band.

14. An enclosure for an open end of a reflector antenna, comprising:

a substantially cylindrical shroud adapted to be coupled to a distal end of the reflector antenna, the shroud generally coaxial with a longitudinal axis of the reflector antenna;

an RF absorbing material coupled to the inner diameter of the shroud;

a retaining band coupled to an inner diameter of the shroud, proximate a distal end of the shroud; the retaining band formed by a plurality of interconnected arc segments;

the retaining band provided with a retaining groove open radially inward towards the longitudinal axis;

a diameter at the bottom of the retaining groove is greater than an outer diameter of the shroud by at least one width of the retaining groove;

a bottom of the retaining groove extending radially outward beyond an outer diameter of the shroud;

a radial inward edge of the retaining band has a smaller inner diameter than the shroud; and a radome seated within the retaining groove without contacting the shroud.

15. Method for assembling an enclosure upon an open end of a reflector antenna, comprising the steps of:

coupling a plurality of portions together to form a substantially cylindrical shroud;

coupling the shroud to a distal end of the reflector antenna, the shroud generally coaxial with a longitudinal axis of the reflector antenna;

coupling a plurality of arc segments together around a periphery of a radome to form a retaining band;

the retaining band provided with a retaining groove open radially inward towards the longitudinal axis, the radome seated in the retaining groove; and coupling a mounting portion to an inner diameter of a distal end of the cylindrical shroud.

* * * * *